US007510221B2

(12) United States Patent
Eenigenburg et al.

(10) Patent No.: US 7,510,221 B2
(45) Date of Patent: Mar. 31, 2009

(54) SASH LOCK ASSEMBLY HAVING FORCED ENTRY RESISTANCE

(75) Inventors: Mark B. Eenigenburg, Lansing, IL (US); Jason L. Annes, Crown Point, IN (US); Edward C. Flory, Crown Point, IN (US)

(73) Assignee: Newell Operating Company, Atlanta, GA (US)

( * ) Notice: Subject to any disclaimer, the term of this patent is extended or adjusted under 35 U.S.C. 154(b) by 17 days.

(21) Appl. No.: 11/673,412

(22) Filed: Feb. 9, 2007

(65) Prior Publication Data

US 2007/0200363 A1 Aug. 30, 2007

Related U.S. Application Data

(60) Provisional application No. 60/771,612, filed on Feb. 9, 2006.

(51) Int. Cl.
*E05C 3/02* (2006.01)

(52) U.S. Cl. ..... 292/240; 292/DIG. 20; 292/DIG. 47

(58) Field of Classification Search ..... 292/336.3, 292/240, 241, DIG. 20, DIG. 47
See application file for complete search history.

(56) References Cited

U.S. PATENT DOCUMENTS

| | | | | |
|---|---|---|---|---|
| 115,781 | A | 6/1871 | Steele | |
| 201,146 | A | 3/1878 | Adler | |
| 215,125 | A | 5/1879 | Hunter | |
| 234,387 | A | 11/1880 | Burgess et al. | |
| 284,993 | A | 9/1883 | Abele | |
| 336,302 | A | 2/1886 | Dudgeon | |
| 353,287 | A | 11/1886 | Chumard | |
| 480,148 | A | 8/1892 | Theby | |
| 564,426 | A | 7/1896 | Hubbard | |
| 587,424 | A * | 8/1897 | Bonine | 292/210 |
| 708,406 | A | 9/1902 | Robison | |

(Continued)

FOREIGN PATENT DOCUMENTS

CA 2192746 A1 12/1997

(Continued)

OTHER PUBLICATIONS

Home Protection Hardware Catalog Price List, dated Jul. 1986, p. 21.

*Primary Examiner*—Gary Estremsky
(74) *Attorney, Agent, or Firm*—Banner & Witcoff, Ltd.

(57) ABSTRACT

A sash lock assembly is suitable for use with a sash window assembly including an upper sash window and a lower sash window slidable within a master frame, the upper sash window having a keeper connected thereto. The sash lock assembly includes a housing adapted to be mounted on the lower sash window, a cam positioned within the housing, an actuator handle, and an anti-rotation device. The housing has an opening therein. The actuator handle extends through the opening in the housing and is connected to the cam such that the actuator handle and the cam rotate together between a locked position, wherein the cam is adapted to engage the keeper, and an unlocked position, wherein the cam is adapted to disengage from the keeper. The anti-rotation device includes a protrusion positioned on the housing. When the sash lock assembly is in the locked position, the protrusion engages an engaging surface on the actuator handle to prevent rotation of the actuator handle.

25 Claims, 4 Drawing Sheets

U.S. PATENT DOCUMENTS 743,716 A 11/1903 Hadka
744,755 A 11/1903 Hasenpflug
756,559 A 4/1904 Arens
878,206 A 2/1908 Johnson
900,079 A 10/1908 Bittorf
910,850 A 1/1909 Petrie
928,408 A 7/1909 Taube
1,041,803 A 10/1912 Kilburn
1,059,999 A 4/1913 James et al.
1,122,026 A 12/1914 O'Rourke
1,148,712 A 8/1915 Overand
1,156,004 A 10/1915 Fuller
1,247,182 A 11/1917 Tueckmantel
1,253,810 A 1/1918 Gianninoto
1,338,250 A 4/1920 Parkes
1,338,416 A 4/1920 Bellinger
1,339,362 A 5/1920 L'Heureux
1,393,628 A 10/1921 Leichter
1,550,532 A 8/1925 French
1,692,579 A 11/1928 Schrader
1,704,946 A 3/1929 Lindgren
1,790,816 A 2/1931 Hiering
1,900,936 A 3/1933 Huttger
1,901,974 A 3/1933 Macy
2,537,736 A 1/1951 Carlson
2,605,125 A 7/1952 Emerson
2,613,526 A 10/1952 Holmsten
2,758,862 A 8/1956 Endter
3,027,188 A 3/1962 Eichstadt
3,135,542 A 6/1964 Wikinson
3,144,688 A 8/1964 Nielsen
3,377,093 A 4/1968 Macoicz
3,405,962 A 10/1968 Sushan
3,438,153 A 4/1969 Lemme
3,645,573 A 2/1972 Strang
3,655,230 A 4/1972 Armstrong
3,706,467 A 12/1972 Martin
3,709,540 A 1/1973 Beilis
3,811,718 A 5/1974 Bates
3,907,348 A 9/1975 Bates et al.
4,059,298 A 11/1977 Van Klompenburg
4,095,827 A 6/1978 Stavenau
4,095,829 A 6/1978 Van Klompenburg
4,102,546 A 7/1978 Costello
4,130,311 A 12/1978 Sushan
4,223,930 A 9/1980 Costello et al.
4,227,345 A 10/1980 Durham, Jr.
4,235,465 A 11/1980 Costello
4,261,602 A 4/1981 Anderson
4,305,612 A 12/1981 Hunt et al.
D268,643 S 4/1983 Anderson
4,558,174 A 12/1985 Massey
4,621,847 A 11/1986 Paulson et al.
4,736,972 A 4/1988 Mosch
4,801,164 A 1/1989 Mosch
4,813,725 A 3/1989 Mosch
D302,651 S 8/1989 Mosch
4,961,286 A 10/1990 Bezubic
D316,509 S 4/1991 Nolte
5,042,855 A 8/1991 Bennett et al.
5,072,464 A 12/1991 Draheim et al.
5,076,015 A 12/1991 Manzalini
5,087,087 A 2/1992 Vetter et al.
5,087,088 A 2/1992 Milam
5,090,750 A 2/1992 Lindqvist
5,110,165 A 5/1992 Piltingsrud
5,127,685 A 7/1992 Dallaire et al.
5,139,291 A 8/1992 Schultz
5,161,839 A 11/1992 Piltingsrud et al.
5,219,193 A 6/1993 Piltingsrud
5,398,447 A 3/1995 Morse
5,448,857 A 9/1995 Stormo
D366,409 S 1/1996 Delaske
5,582,445 A 12/1996 Olsen et al.
RE35,463 E 2/1997 Vetter et al.
5,715,631 A 2/1998 Kailian et al.
5,741,032 A 4/1998 Chaput
5,778,602 A 7/1998 Johnson et al.
5,839,767 A 11/1998 Piltingsrud
5,901,499 A 5/1999 Delaske et al.
5,992,907 A 11/1999 Sheldon et al.
6,116,665 A 9/2000 Subliskey
6,123,373 A 9/2000 Yoshida
6,142,541 A 11/2000 Rotondi
6,349,576 B2 2/2002 Subliskey
6,406,076 B1 6/2002 Zarzycki, Jr.
6,634,683 B1 10/2003 Brannan
6,817,142 B2 11/2004 Marshik
6,925,758 B2 8/2005 Pettit
6,983,963 B2 * 1/2006 Eslick et al. ..... 292/242
7,063,361 B1 6/2006 Lawrence
7,100,951 B2 9/2006 Jien

FOREIGN PATENT DOCUMENTS

CA 2210026 C 9/1998
CA 2256643 A1 5/2000
CA 2312095 A1 12/2000
GB 341207 1/1931
GB 2026594 A 2/1980

* cited by examiner

SASH LOCK ASSEMBLY HAVING FORCED ENTRY RESISTANCE

CROSS-REFERENCE TO RELATED APPLICATIONS

The present application claims priority to and the benefit of U.S. Provisional Application Ser. No. 60/771,612, filed on Feb. 9, 2006, which application is incorporated herein by reference and made a part hereof.

TECHNICAL FIELD

The present invention relates to sash window hardware and, more particularly, to a sash lock assembly for use in sash windows.

BACKGROUND OF THE INVENTION

A sash window assembly having a pivotal sash window adapted for installation in a master frame is well-known. The master frame typically has opposed, vertically extending guide rails to enable vertical reciprocal sliding movement of the sash window in the master frame while cooperatively engaged with the guide rails. The sash window may have an upper sash window and a lower sash window. The sash window also has a top sash rail, a base and a pair of stiles cooperatively connected together at adjacent extremities thereof to form a sash frame.

Hardware is associated with the sash window assembly such as tilt-latches and a sash lock assembly. Tilt-latches are supported by the top sash rail and releasably engage the guide rails to allow the sash window to pivot from the master frame. The sash lock assembly provides a locking mechanism between the upper sash window and the lower sash window. The sash lock assembly typically has one component that is supported by the top sash rail of the lower sash window and another component that is supported by the base of the upper sash rail. The sash lock components cooperate to provide the locking mechanism wherein the lower sash window and the upper sash window are prevented from sliding within the master frame.

One problem associated with typical sash locks is their ability to be manipulated by an intruder from outside the sash window assembly. Sash locks generally include some type of rotatable actuator arm and cam. The actuator is rotatable from a locked to an unlocked position. With some sash locks, the actuator arm or cam may be manipulated from the outside by a skilled intruder using a thin knife, stiff wire, or other diabolical tool of intrusion. Accordingly, while the sash lock assemblies provide a number of advantageous features, they nevertheless have certain limitations. The present invention seeks to overcome certain of these limitations and other drawbacks of the prior art, and to provide new features not heretofore available.

SUMMARY OF THE INVENTION

The present disclosure provides a sash lock assembly that incorporates forced entry resistance. The sash lock assembly is suitable for use with a sash window assembly including an upper sash window and a lower sash window slidable within a master frame, the upper sash window having a keeper connected thereto. The sash lock assembly includes a housing adapted to be mounted on the lower sash window, a cam positioned within the housing, an actuator handle, and an anti-rotation device. The housing has an opening therein. The actuator handle extends through the opening in the housing and is connected to the cam such that the actuator handle and the cam rotate together between a locked position, wherein the cam is adapted to engage the keeper, and an unlocked position, wherein the cam is adapted to disengage from the keeper. The anti-rotation device includes a protrusion positioned on the housing. When the sash lock assembly is in the locked position, the protrusion engages an engaging surface on the actuator handle to prevent rotation of the actuator handle.

According to one aspect, the actuator handle has a tab extending therefrom. The tab has the engaging surface thereon such that the protrusion engages the tab when the sash lock assembly is in the locked position.

According to another aspect, the housing has a top surface having an upper surface and a lower surface. The opening is positioned in the upper surface, and the protrusion is positioned on the upper surface. The actuator handle has a base, a shaft projecting downwardly from the base through the opening to connect to the cam, and a lever projecting outwardly from the base substantially perpendicular to the shaft. The actuator handle has a tab extending from the base. The tab has the engaging surface thereon such that the protrusion engages the tab when the sash lock assembly is in the locked position. Upon downward deflection of the lever when the sash lock assembly is in the locked position, the tab moves to clear the protrusion, permitting movement of the actuator to place the sash lock assembly in the unlocked position.

According to another aspect, the engaging surface is located on the lever such that the protrusion engages the lever when the sash lock assembly is in the locked position. Upon upward deflection of the lever when the sash lock assembly is in the locked position, the engaging surface moves to clear the protrusion, permitting movement of the actuator to place the sash lock assembly in the unlocked position.

According to another aspect, the protrusion is positioned on the lower surface of the top surface of the housing. The actuator handle has a tab extending from an underside of the lever. The tab has the engaging surface thereon such that the protrusion engages the tab when the sash lock assembly is in the locked position. The tab is resilient, wherein upon application of sufficient rotational force to the actuator handle when the sash lock mechanism is in the locked position, the resilient tab flexes to clear the protrusion, permitting movement of the actuator to place the sash lock assembly in the unlocked position.

According to another aspect, the protrusion has an engaging surface that is generally perpendicular to a top surface of the housing and engages the engaging surface of the actuator handle when the sash lock assembly is in the locked position. The protrusion also has an inclined surface. The inclined surface engages and deflects the actuator handle when the actuator rotates to move the sash lock assembly from the unlocked position to the locked position. According to a further aspect, the protrusion is arcuate in shape.

The present disclosure also provides a sash lock assembly suitable for use with a sash window assembly including an upper sash window and a lower sash window slidable within a master frame, the upper sash window having a keeper connected thereto. The sash lock assembly includes a housing adapted to be mounted on the lower sash window, a cam positioned within the housing, an actuator handle, and an anti-rotation device. The housing has an opening therein. The actuator handle extends through the opening in the housing and is connected to the cam such that the actuator handle and the cam rotate together between a locked position, wherein the cam is adapted to engage the keeper, and an unlocked position, wherein the cam is adapted to disengage from the keeper. The anti-rotation device includes a protrusion positioned on the housing and a tab extending from the actuator handle. When the sash lock assembly is in the locked position, the protrusion engages the tab to prevent rotation of the actuator handle. Upon deflection of the actuator handle, the tab moves to clear the protrusion, permitting movement of the actuator to place the sash lock assembly in the unlocked position.

According to one aspect, the actuator handle has a base, a shaft projecting downwardly from the base through the opening to connect to the cam, and a lever projecting outwardly from the base and substantially perpendicular to the shaft. The tab extends from a side of the base generally opposite of the lever, and the lever deflects downwardly to move the tab upwardly to clear the protrusion.

The present disclosure further provides a sash lock assembly suitable for use with a sash window assembly including an upper sash window and a lower sash window slidable within a master frame, the upper sash window having a keeper connected thereto. The sash lock assembly includes a housing adapted to be mounted on the lower sash window, a cam positioned within the housing, an actuator handle, and an anti-rotation device. The housing has an opening therein. The actuator handle extends through the opening in the housing and is connected to the cam such that the actuator handle and the cam rotate together between a locked position, wherein the cam is adapted to engage the keeper, and an unlocked position, wherein the cam is adapted to disengage from the keeper. The anti-rotation device includes a protrusion positioned on the housing and a resilient tab positioned on the actuator handle. When the sash lock assembly is in the locked position, the protrusion engages a portion of the actuator handle to prevent rotation of the actuator handle. Upon application of sufficient rotational force to the actuator handle, the resilient tab flexes to clear the protrusion, permitting movement of the actuator to place the sash lock assembly in the unlocked position.

According to one aspect, the actuator handle has a base, a shaft projecting downwardly from the base through the opening to connect to the cam, and a lever projecting outwardly from the base and substantially perpendicular to the shaft. The tab extends from an underside of the lever.

These and other objects and advantages will be made apparent from the following description of the drawings and detailed description of the invention.

BRIEF DESCRIPTION OF THE DRAWINGS

To understand the present invention, it will now be described by way of example, with reference to the accompanying drawings in which.

DETAILED DESCRIPTION

Figure 1:
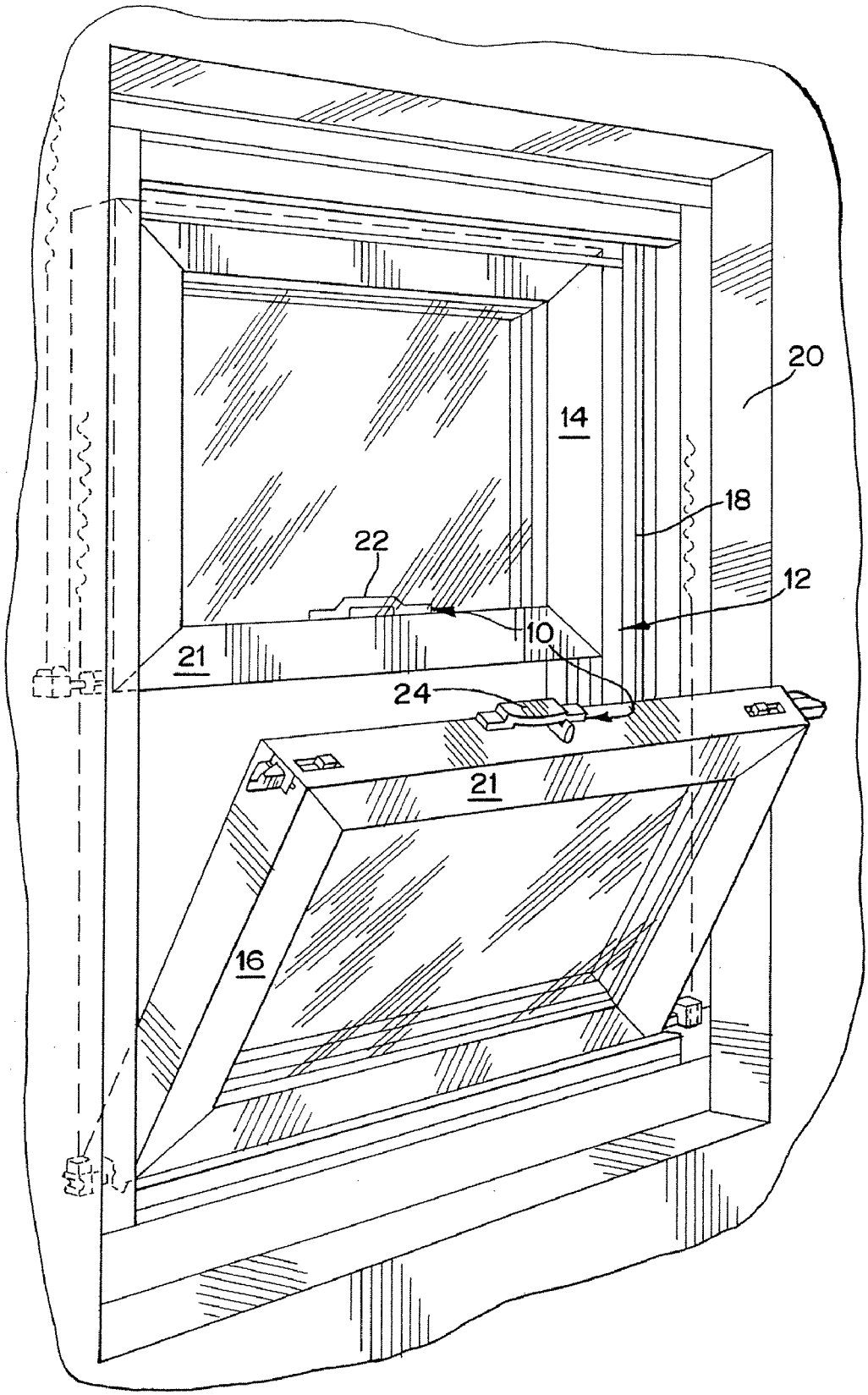
FIG. 1 is a perspective view of a sash window assembly.

While this invention is susceptible of embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

A sash lock assembly 10 for a sash window assembly 12 is illustrated in the FIGURES. As generally shown in FIG. 1, the sash window assembly 12 includes an upper sash window 14 and a lower sash window 16. Each of the sash windows 14, 16 is mounted within opposed guide rails 18 on a master frame 20. At least one of the sash windows 14, 16 is slidable within the master frame 20 relative to the other of the sash windows 14, 16. Each sash window 14, 16 has a pair of horizontal frame members or rails 21.

The sash window assembly 12 described herein is typically made from vinyl extrusions known in the art. The disclosed sash lock assembly 10 can be used with any type of sash window assembly 12. In one exemplary embodiment, the sash lock assembly 10 is used with sash windows 14, 16, and a master frame 20 made of vinyl. In other embodiments, the sash lock assembly 10 can be used with a sash window assembly 12 made from wood, masonite or press board, or from extrusions or pulltrusions that are filled with fiberglass, epoxy, plastic, or wood chips, or from other materials, including aluminum.

The sash lock assembly 10 includes a keeper 22 and a locking assembly 24. The keeper 22 is generally a known structure. The keeper 22 typically includes a keeper surface (not shown) and a pair of mount holes (not shown) for mounting the keeper 22 to one of the frame members 21, as described more fully below.

Figure 2:
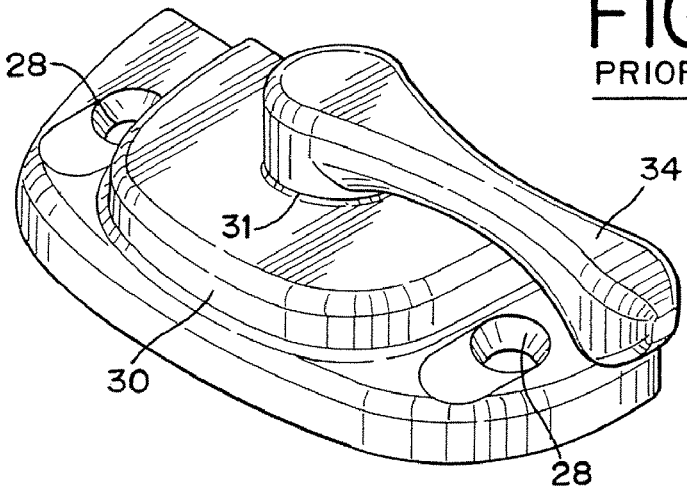
FIG.2 PRIOR ART
FIG. 2 is a perspective view of a prior art sash lock assembly.
Figure 3:
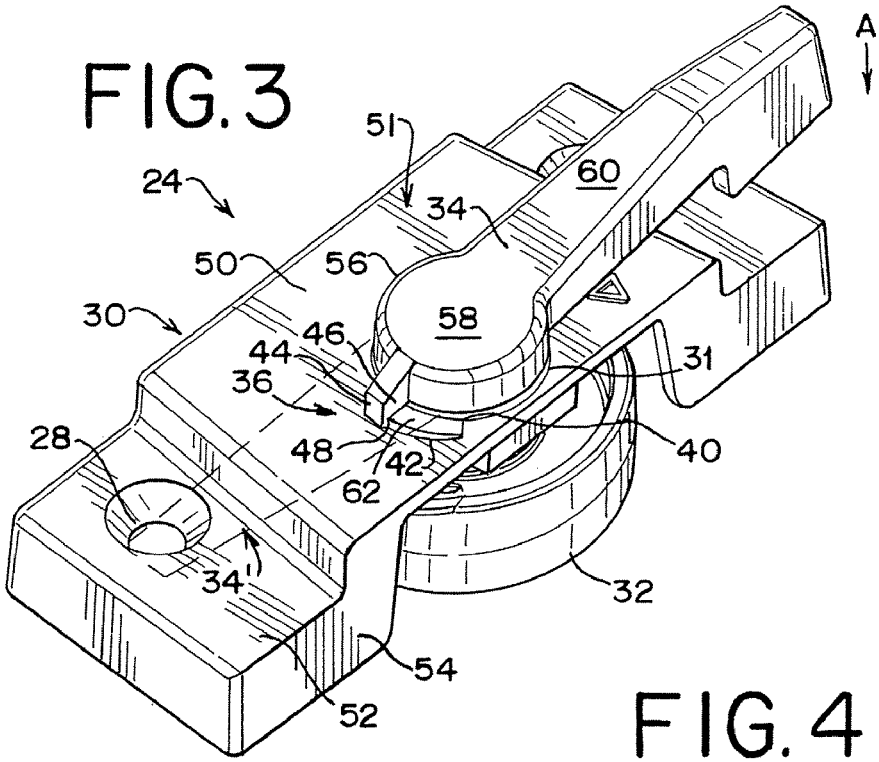
FIG. 3 is a perspective view of a sash lock assembly having an anti-rotation device.

One embodiment of the locking assembly 24 is shown in FIG. 3 and includes a housing 30, a cam 32, an actuator handle 34 and a forced entry resistance device or anti-rotation device 36. An example of a locking assembly 24 of the prior art without the anti-rotation device 36, is shown in FIG. 2.

As shown in FIG. 3, the housing 30 includes a pair of mount holes 28. The mount holes 28 receive fasteners (not shown) as described in greater detail below. The housing 30 defines an interior cavity 33. The housing 30 has a central aperture or opening 31 in communication with the interior cavity 33. The housing 30 shown in FIG. 3 has a top surface or platform 51 that includes an upper surface 50 and a pair of recessed portions 54 defining a pair of lower surfaces 52. As shown in FIG. 3, a generally vertical wall spans between the top surface 51 and the recessed portions 54. The opening 31 is located in the upper surface 50 of the housing 30.

The cam 32 includes a cam surface 40. The cam 32 is positioned within the interior cavity 33 of the housing 30. The cam 32 is adapted to engage and cooperate with the keeper 22 to lock the sash window assembly 12 in a closed position as described below.

The actuator handle 34 is generally positioned above the housing 30 and extends out over the housing 30 so that it can be rotated about the housing 30. The actuator handle 34 is connected to the cam 32 such that the actuator handle 34 and the cam 32 rotate together. The actuator handle 34 has a base 56, a shaft 58 extending downward from the base 56, and a lever 60 extending outward from the base 56 and substantially perpendicular to the shaft 58. The shaft 58 extends downwardly through the opening 31 in the housing 30 and connects the cam 32 to the actuator handle 34. It is understood that the actuator handle 34 and the shaft 58 can be a single integral member if desired. As the base 56 is dimensioned to fit within the opening 31 and the shaft 58 extends through the opening 31 and is connected to the cam 32, the cam 32 and actuator handle 34 are rotatably mounted to the housing 30. That is, there is substantially no relative movement between the cam 32 and actuator handle 34, and the cam 32 and actuator handle 34 together with respect to the housing 30. It is understood that there may be a certain amount of "play" in the connection between the cam 32 and the handle 34. Thus, the handle 34 can pivot a certain distance with respect to the cam 32. This pivoting movement allows the handle 34 to pivot from a vertical axis and move along an arc such that vertical positions of the handle can be varied as discussed in greater detail below. A spring washer (not shown) used in this connection assists with this movement. The lever 60 is adapted to be manipulated by a user to rotate the actuator handle 34 and cam 32 to operate the sash lock assembly 10, as described below. The rotation of the actuator handle 34 is generally in a horizontal plane.

In this embodiment, the anti-rotation device 36 comprises a cooperative structure between the actuator handle 34 and the housing 30. The anti-rotation device 36 generally includes an engaging surface 48 on the housing 30 that engages an engaging surface 46 on the actuator handle 34 to prevent or obstruct movement of the handle 34 from the locked position. In the embodiment shown in FIG. 3, the anti-rotation device 36 includes a protrusion 42 on the housing 30 and a tab 44 on the actuator handle 34. The protrusion 42 is located on the upper surface 50 of the housing 30 and follows the arcuate periphery of the base 56 of the actuator handle 34 and central aperture 31 of the housing 30. Thus, the protrusion 42 is arcuate in shape in one exemplary embodiment of the invention. Further, the protrusion 42 is inclined, wherein the height of the protrusion 42 increases as it approaches the tab 44 when the anti-rotation device 36 is in the locked position. The tallest end of the protrusion 42 has an engaging surface 48, which is generally transverse to the upper surface 50 of the housing 30. In this embodiment, the tab 44 is in line with the lever 60 of the actuator handle 34 and extends outwardly from the base 56 generally on the opposite side as the lever 60. The top surface of the tab 44 slopes downward. The bottom surface of the tab 44 is located adjacent the upper surface 50 of the housing. The tab 44 has an engaging surface 46, which is generally transverse to the upper surface 50 of the housing 30.

The actuator handle 34 of the locking assembly 24 is rotatable between a locked position and an unlocked position to adjust the sash lock assembly 10 between a locked position and an unlocked position. In the locked position, shown in FIG. 3, the cam 32 has rotated and its cam surface 40 is substantially external to the housing 30 and engages the keeper 22 to lock the sash window assembly 12 in the closed position. In the unlocked position, shown by broken lines in FIG. 3, the cam 32 disengages from the keeper 22 and generally is located completely within the housing 30, and the sash window assembly 12 is free to be opened.

In the embodiment shown, the keeper 22 is mounted to the lower frame member or base 21 of the upper sash window 14 (FIG. 1). The keeper 22 is mounted with a pair of screws or other fasteners extending through the mount holes 28 and secured to the base 21. Typically, the keeper 22 is mounted near the center of the base 21.

In the embodiment shown, the locking assembly 24 is mounted to the upper frame member 21, or top rail 21, of the lower sash window 16 such that it is immediately adjacent to the keeper 22 when the upper sash window 14 is in its upper most position within the master frame 20 and the lower sash window 16 is in its lower most position within the master frame 20. In mounting the locking assembly 24, a screw or other fastener (not shown) passes through one of the mount holes 28 of the locking assembly 24 and secured to the top rail 21 (see FIG. 1.) Another screw or fastener is then used to secure the housing 30 to the top rail 21 via its other mount hole 28. In the embodiments shown, the protrusion 42 of the anti-rotation device 36 is in a position to be immediately adjacent to the engaging surface 46 of the actuator handle 34 when the actuator handle 34 is in its locked position. It is understood that the sash window assembly 12 may only have a single moveable sash window 16, and the keeper 22 may be located on another structure.

The locking assembly 24 depicted in FIG. 3 is configured such that the actuator handle 34 rotates in a counterclockwise direction when rotating from the locked to the unlocked position. This movement of the actuator handle 34 is illustrated via broken lines in FIG. 3, where the actuator handle in the unlocked position is designated by reference number 34'. However, it is understood that the locking assembly 24 may be configured such that its actuator handle 34 rotates in a clockwise direction in moving from the locked to the unlocked position. In this instance, the protrusion 42 may be mounted on the other side of the housing 30 and the tab 44 may be mounted on the other side of the actuator handle 34. It is understood the components anti-rotation device 36 may be positioned at various locations on the locking assembly 24, based on the configuration of the actuator handle 34 and the housing 30.

Figure 8:
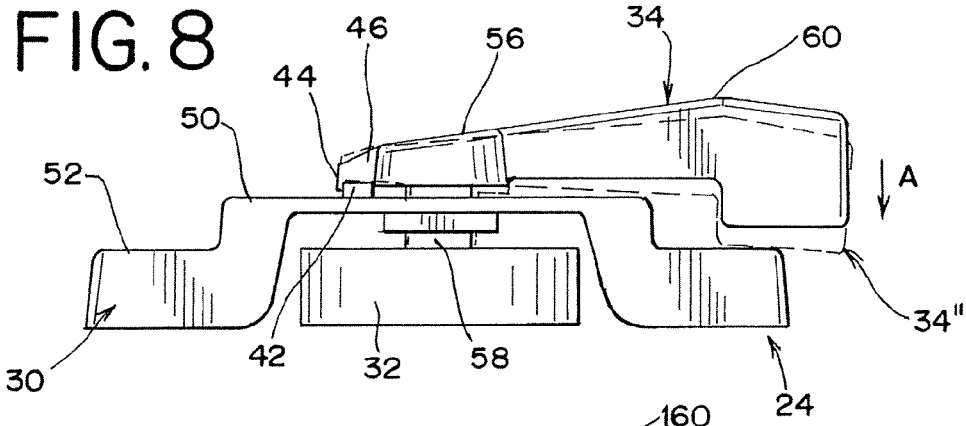
FIG. 8 is a schematic view of the sash lock assembly of FIG. 3.

In operation, when the actuator handle 34 is in the locked position, as shown in FIG. 3, the cam 32 is positioned outside of the housing 30. In this position, the cam surface 40 engages the keeper 22, locking the sash window assembly 12. The tab engaging surface 46 and the protrusion engaging surface 48 confront each other and engage or otherwise abut to prevent or obstruct rotation of the actuator handle 34 from the locked position. Thus, if the cam 32 or handle 34 were attempted to be manipulated from outside of the sash window assembly 12, the cooperating engaging surfaces 46, 48 would prevent movement. To rotate the actuator handle 34 to its unlocked position, the engaging surface 46 of the actuator handle 34 is deflected upward to clear the protrusion 42 and allow the handle 34 to be rotated. In the embodiment shown in FIG. 3, the lever 60 of the actuator handle 34 is depressed downwards, such as by a user. Thus, the actuator handle 34 is pivoted generally from a vertical axis. The "play" between the handle 34 and cam 32 allows for the pivoting movement. FIG. 8 shows a schematic view illustrating the "play" allowing pivoting of the actuator handle 34, with the pivoting of the actuator handle 34 illustrated by broken lines. The force on the actuator handle 34 deflects the lever 60 in the direction of arrow A and causes the actuator handle 34 to pivot in the direction of arrow A, which causes the tab 44 to move or deflect upward. The deflection of the tab 44 disengages or moves the tab engaging surface 46 away from the protrusion engaging surface 48, which clears the rotational path of the actuator handle 34, permitting movement of the actuator 34 to place the sash lock assembly 10 in the unlocked position.

Put another way, when the sash lock assembly 10 is in the locked position, the actuator handle 34 is moveable between a first position and a second position. In the first position, illustrated by solid lines in FIGS. 3 and 8, the protrusion 42 engages the engaging surface 46 of the actuator handle 34 to prevent rotation of the actuator handle 34 to move the assembly 10 to the unlocked position. In the second position, illustrated by broken lines in FIG. 8, the engaging surface 46 of the actuator handle moves to clear the protrusion 42 and allow rotation of the actuator handle 34 to move the assembly 10 to the unlocked position. In the embodiment illustrated in FIGS. 3 and 8, this movement of the actuator handle 34 is accomplished by pivoting in the direction of arrow A, which moves the tab 44 upward with respect to the protrusion 42. As shown in FIG. 8, the actuator handle 34 pivots with respect to the cam 32, via the "play" discussed above. The actuator handle in the second position is designated by reference number 34" in FIG. 8.

In the window assembly 12 shown in FIG. 1, when the actuator handle 34 is in the unlocked position, the lower sash window 16 can slide relative to the master frame 20, such as to raise the lower sash window 16 to open the sash window assembly 12. When it is desired to once again close and lock the window, the upper sash window 14 is maintained in its upper most position within the master frame 20 and the lower sash window 16 is lowered to its lower most position within the master frame 20, which brings the locking assembly 24 to a position immediately adjacent the keeper 22. The actuator handle 34 is then rotated towards the locked position. Rotation of the actuator handle 34 rotates the cam 32 to a position external to the housing 30 and causes the cam surface 40 to engage the keeper 22, in a manner commonly known to those of ordinary skill in the art. As the actuator handle 34 approaches the locked position, the tab 44 of the handle 34 engages the inclined surface 62 of the protrusion 42, which deflects the actuator handle 34, causing the handle 34 to ride up along the inclined surface 62. Once the tab 44 passes the protrusion 42, the tab 44 returns to the position shown in FIG. 3 wherein the engaging surface 48 of the protrusion 42 confronts the engaging surface 46 of the tab 44. By riding up the inclined surface 62 of the protrusion 42, an additional separate pivoting force on the handle 34 is not necessary. Once in the locked position, the engaging surfaces 46,48 of the tab 44 and protrusion 42 abuttingly engage if the cam 32 or handle 34 is attempted to be rotated. As discussed above, to move the handle 34 to the unlocked position, the handle 34 is pivoted so that the tab 44 deflects upward to clear the protrusion 42 so the handle 34 can be rotated.

It is understood that the engaging surface 46 of the actuator handle 34 can move or deflect upwardly by other means, including by flexing or by non-pivoting upward movement. For example, the tab 44 can be extended and retracted to engagement and disengagement positions. The actuator handle 34 could extend upwards along a vertical axis to clear the protrusion 42. It is also understood that the components of the anti-rotation mechanism 36 described above can be positioned elsewhere on the sash lock mechanism 10 while retaining the disclosed advantageous functionality. Further, the anti-rotation mechanism 36 can be used with other sash lock mechanisms having a variety of different designs.

Figure 4:
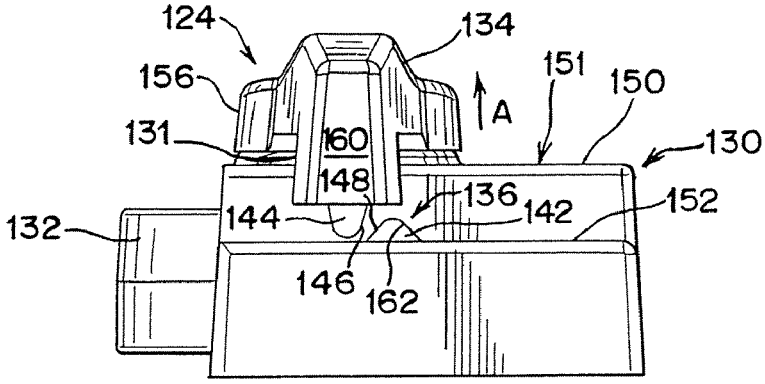
FIG. 4 is a side elevation view of a sash lock assembly having an alternative embodiment of an anti-rotation device.
Figure 5:
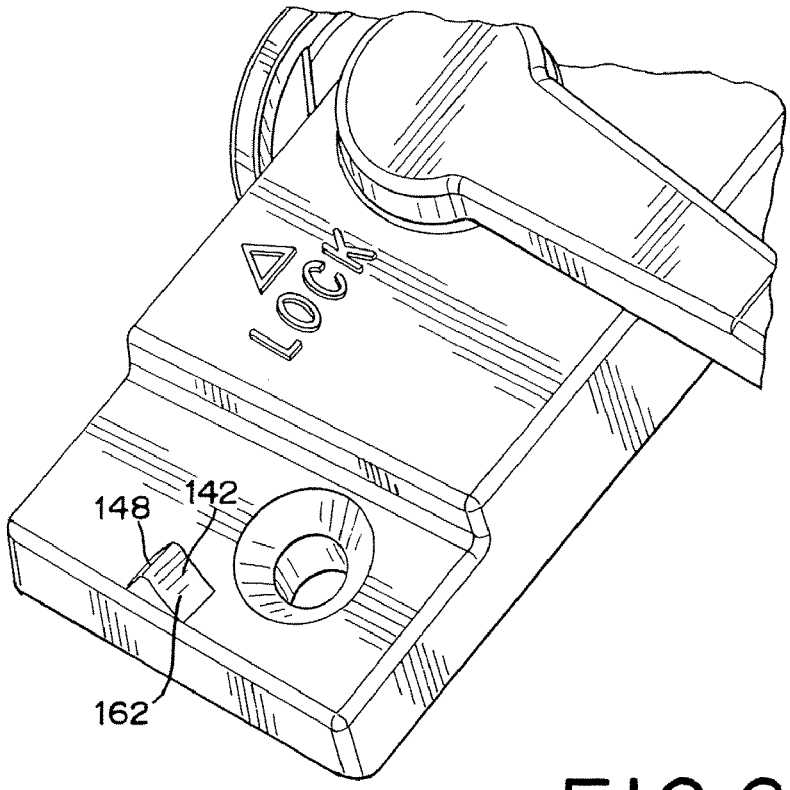
FIG. 5 is a perspective view of a component of the anti-rotation device of FIG. 4.
Figure 6:
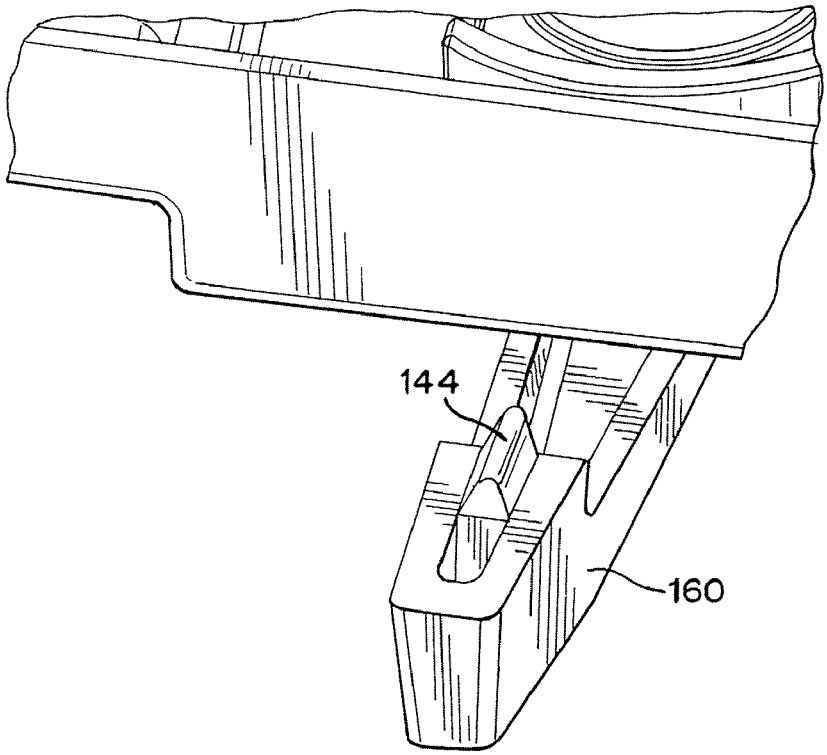
FIG. 6 is a bottom view of another component of the anti-rotation device of FIG. 4.

Another embodiment of a locking assembly 124 of the sash lock assembly 10 is illustrated in FIGS. 4-6. In this embodiment, the general components of the locking assembly 124 are the same as those described above with respect to the locking assembly 24, with the exception of the anti-rotation device 136. The anti-rotation device 136 generally includes a protrusion 142 located on the housing 130 and a tab 144 located on the actuator handle 134. In the embodiment shown in FIGS. 4-6, the protrusion 142 is located on the lower surface 152 of the top surface 151 of the housing 130, thus generally at the recessed portion of the housing. The protrusion 142 is a rounded lip with sloping sides, and has an engaging surface 148 and an inclined surface 162. In this embodiment, the tab 144 is substantially the same shape as the protrusion 142. The tab 144 is located on the underside of the lever 160 of the actuator arm 134 and extends downward therefrom. Thus, the tab 144 is inverted with respect to the protrusion, so that when the locking assembly 124 is in the locked position, the tab 144 hovers above the lower surface 152 of the housing 130. The tab 144 has an engaging surface 146 which faces the engaging surface 148 of the protrusion 142 when the locking assembly 124 is in the locked position. In this embodiment, the tab 144 is a separate piece inserted into the actuator handle 134. However, it is understood that the tab 144 could be integral with the actuator handle 134.

Figure 9:
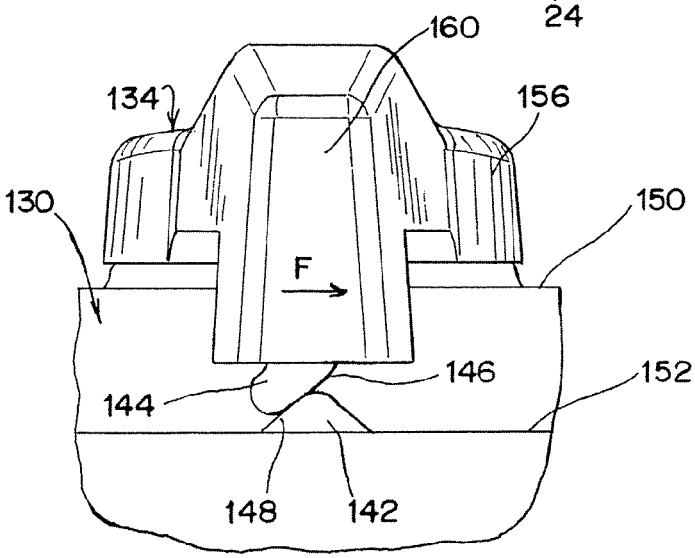
FIG. 9 is a partial schematic view of the sash lock assembly of FIG. 4.

In this embodiment, the tab 144 is made of a pliable or resiliently flexible material. Thus, rotating the actuator handle 134 from the locked to the unlocked position does not require any upward deflection of the actuator handle 134. The tab 144 will be flexible enough so that upon application of sufficient rotational force to the actuator handle 134, the resilient tab will flex or temporarily deform in order to clear the protrusion 142, permitting movement of the actuator 134 to place the sash lock assembly 10 in the unlocked position. FIG. 9 illustrates flexing of the tab 144 by contact with the protrusion 142 upon application of rotational force F, allowing the tab 144 to clear the protrusion 142. When the sash lock assembly 10 is returned to the locked position, the tab 144 engages the inclined surface 162 of the protrusion 142 and flexes to clear the protrusion 142 to permit the actuator handle 234 to return to the locked position.

In the embodiment shown in FIGS. 4-6, the tab 144 can alternately made from a nondeformable material such as metal. In this embodiment, the tab 144 is deflected upward to clear the protrusion 142, permitting the actuator handle 134 to rotate to the unlocked position. In one embodiment, the actuator handle 134 is resiliently flexible, allowing the lever 160 to flex upward, in the direction of arrow A in FIG. 4, to deflect the tab 144 as necessary. In another embodiment, the entire actuator handle 134 may move to deflect the tab 144 to clear the protrusion 142, in a manner such as that as described above. For example, the lever 160 may move upward, in the direction of arrow A in FIG. 4, causing the actuator handle 134 to pivot in the direction of arrow A. Thus, in either configuration, when moving the locking assembly 124 from the locked to the unlocked position, the lever 160 of the actuator handle 134 will move in an upward direction, shown by arrow A, in order for the tab 144 to clear the protrusion 142. When the sash lock assembly 10 is returned to the locked position, the tab 144 engages the inclined surface 162 of the protrusion 142 and deflects upward to ride up along the inclined surface 162, as described above, until the actuator handle 134 returns to the locked position.

Figure 7:
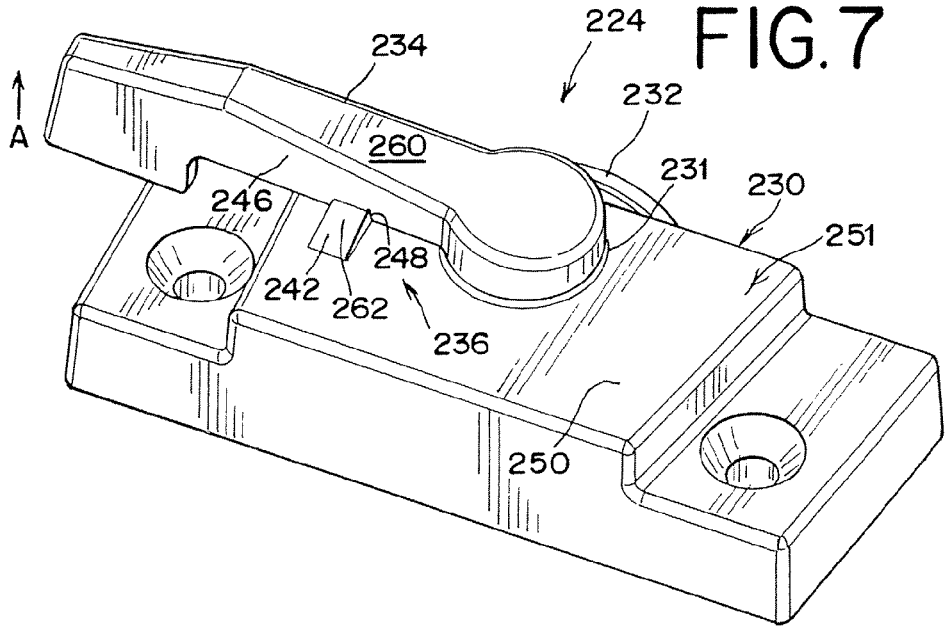
FIG. 7 is a perspective view of a sash lock assembly having another alternative embodiment of an anti-rotation device.

A further exemplary embodiment of a locking assembly 224 for a sash lock assembly 10 is shown in FIG. 7. In this embodiment, the general components of the locking assembly 124 are the same as those described above with respect to the locking assembly 24, with the exception of the anti-rotation device, generally designated with the reference numeral 236. The anti-rotation device 236 generally includes a protrusion 242 located on the upper surface 250 of the top surface 251 of the housing 230. The protrusion 242 is positioned generally between the opening 31 and the end portion of the upper surface 250 generally adjacent the recessed portion of the housing 230. The protrusion 242 is wedge shaped and has an inclined surface 262 and an engaging surface 248 that is generally transverse to the upper surface 250 of the housing 230. In this embodiment, the engaging surface 246 of the actuator handle 234 is located on the side of the lever 260. Thus, the lever 260 of the actuator handle 234 acts as the tab and the engaging surface 246. In one exemplary embodiment, the engaging surface 246 is defined generally around a mid-portion of the actuator handle 234. This positioning can vary depending on the positioning of the protrusion 242 on the upper surface 250. The engaging surface 246 can be positioned between the base of the actuator handle 234 and a distal end of the actuator handle 234. When the sash lock assembly 10 is in the locked position, the engaging surface 248 of the protrusion 242 confronts the engaging surface 246 of the lever 260 to prevent or obstruct rotation of the actuator handle 234 to move the sash lock assembly 10 to the unlocked position.

In order to go from the locked to unlocked position, the actuator handle 234 deflects to clear the protrusion 242. For example, the actuator handle 234 can be pivoted by a user in the direction of arrow A in FIG. 7, which causes the engaging surface 246 on the lever 260 to deflect upward in the direction of arrow A to clear the protrusion 242. Once the engaging surface 246 of the actuator handle 234 clears the protrusion 242, the actuator handle 234 can then be rotated to move the sash lock assembly 10 to the unlocked position. When the sash lock assembly 10 is returned to the locked position, the lever 260 engages the inclined surface 262 of the protrusion 242 and deflects upward to ride up along the inclined surface 262, as described above, until the actuator handle 234 returns to the locked position. It is understood that in the embodiment shown in FIG. 7, the actuator handle 234 is pivoted upwards from a vertical axis wherein the engagement surface 246 on the handle is raised upwards to clear the engaging surface 248 on the protrusion 242. It is further understood that similar to the embodiments discussed above, the "play" between the actuator handle 234, housing 230 and cam can provide for the necessary pivoting movement of the actuator handle 234. As discussed, the actuator handle of the different embodiments of the invention can be pivoted and depressed upwards or downwards to provide the necessary movement to gain clearance between the cooperating engaging surfaces of the anti-rotation devices of the present invention.

Although the invention has been described as being applied to a vertically sliding double hung window, it is understood the invention can equally be applied to horizontally sliding sash window arrangements or any operable sash window that slides within a frame. It is also understood that the various components of the sash lock assembly can be made from plastic or metal. Plastic components may have integral molded parts, and metal components may have integral cast parts.

It can be appreciated that the anti-rotation device 36 of the present invention will prevent simple rotation of the actuator handle 34 without additional manipulation of the device 36. The anti-rotation device 36, while not intruder-proof, will provide significant deterrence to forced entry and unwanted manipulation of the sash lock assembly 10 from outside the sash window assembly 12. The anti-rotation device 36 is simple in construction.

While the specific embodiments have been illustrated and described, numerous modifications come to mind without significantly departing from the spirit of the invention and the scope of protection is only limited by the scope of the accompanying Claims.

What is claimed is:

1. A sash lock assembly for a sash window assembly, the sash window assembly having an upper sash window and a lower sash window slidable within a master frame, the upper sash window having a keeper connected thereto, the sash lock assembly comprising:

a housing adapted to be mounted on the lower sash window, the housing having an opening therein;

a cam positioned within the housing;

an actuator handle extending through the opening in the housing and connected to the cam such that the actuator handle and the cam rotate together in a generally horizontal plane, the actuator handle rotatable to adjust the sash lock assembly between a locked position, wherein the cam is adapted to engage the keeper, and an unlocked position, wherein the cam is adapted to disengage from the keeper; and an anti-rotation device comprising a protrusion positioned on the housing, wherein when the sash lock assembly is in the locked position, the protrusion engages an engaging surface on the actuator handle to prevent rotation of the actuator handle, and wherein upon generally vertical deflection of the actuator handle when the sash lock assembly is in the locked position, the engaging surface moves to clear the protrusion, permitting movement of the actuator to place the sash lock assembly in the unlocked position.

2. The sash lock assembly of claim 1, wherein the actuator handle has a tab extending therefrom, the tab having the engaging surface thereon such that the protrusion engages the tab when the sash lock assembly is in the locked position.

3. The sash lock assembly of claim 1, wherein the housing has a top surface having an upper surface and a lower surface, the opening positioned in the upper surface, and the protrusion positioned on the upper surface.

4. The sash lock assembly of claim 3, wherein the actuator handle has a base, a shaft projecting downwardly from the base through the opening to connect to the cam, and a lever projecting outwardly from the base substantially perpendicular to the shaft, wherein the actuator handle has a tab extending from the base, the tab having the engaging surface thereon such that the protrusion engages the tab when the sash lock assembly is in the locked position.

5. The sash lock assembly of claim 4, wherein upon downward deflection of the lever when the sash lock assembly is in the locked position, the tab moves to clear the protrusion, permitting movement of the actuator to place the sash lock assembly in the unlocked position.

6. The sash lock assembly of claim 3, wherein the actuator handle has a base, a shaft projecting downwardly from the base through the opening to connect to the cam, and a lever projecting outwardly from the base and substantially perpendicular to the shaft, wherein the engaging surface is located on the lever such that the protrusion engages the lever when the sash lock assembly is in the locked position.

7. The sash lock assembly of claim 6, wherein upon upward deflection of the lever when the sash lock assembly is in the locked position, the engaging surface moves to clear the protrusion, permitting movement of the actuator to place the sash lock assembly in the unlocked position.

8. The sash lock assembly of claim 1, wherein the housing has a top surface having an upper surface and a lower surface, the opening positioned in the upper surface, and the protrusion positioned on the lower surface.

9. The sash lock assembly of claim 8, wherein the actuator handle has a base, a shaft projecting downwardly from the base through the opening to connect to the cam, and a lever projecting outwardly from the base and substantially perpendicular to the shaft, wherein the actuator handle has a tab extending from an underside of the lever, the tab having the engaging surface thereon such that the protrusion engages the tab when the sash lock assembly is in the locked position.

10. The sash lock assembly of claim 9, wherein the tab is resilient, and wherein upon application of sufficient rotational force to the actuator handle when the sash lock mechanism is in the locked position, the resilient tab flexes to clear the protrusion, permitting movement of the actuator to place the sash lock assembly in the unlocked position.

11. The sash lock assembly of claim 1, wherein deflection of the actuator handle is accomplished via pivoting of the actuator handle to raise the engaging surface above the protrusion.

12. The sash lock assembly of claim 1, wherein the actuator handle is resiliently flexible and deflection of the actuator handle is accomplished via flexing of the actuator handle to raise the engaging surface above the protrusion.

13. The sash lock assembly of claim 1, wherein the protrusion has an inclined surface, and wherein the inclined surface engages and deflects the actuator handle when the actuator rotates to move the sash lock assembly from the unlocked position to the locked position.

14. The sash lock assembly of claim 1, wherein the protrusion is arcuate in shape.

15. A sash lock assembly for a sash window assembly, the sash window assembly having an upper sash window and a lower sash window slidable within a master frame, the upper sash window having a keeper connected thereto, the sash lock assembly comprising:

a housing adapted to be mounted on the lower sash window, the housing having an opening therein;

a cam positioned within the housing;

an actuator handle extending through the opening in the housing and connected to the cam such that the actuator handle and the cam rotate together in a generally horizontal plane, the actuator handle rotatable to adjust the sash lock assembly between a locked position, wherein the cam is adapted to engage the keeper, and an unlocked position, wherein the cam is adapted to disengage from the keeper; and an anti-rotation device comprising a protrusion positioned on the housing and a tab extending from the actuator handle, wherein when the sash lock assembly is in the locked position, the protrusion engages the tab to prevent rotation of the actuator handle, and wherein upon generally vertical deflection of the actuator handle, the tab moves to clear the protrusion, permitting movement of the actuator to place the sash lock assembly in the unlocked position.

16. The sash lock assembly of claim 15, wherein the actuator handle has a base, a shaft projecting downwardly from the base through the opening to connect to the cam, and a lever projecting outwardly from the base and substantially perpendicular to the shaft, wherein the tab extends from the base.

17. The sash lock assembly of claim 16, wherein the tab extends from a side of the base generally opposite of the lever, and the lever deflects downwardly to move the tab upwardly to clear the protrusion.

18. A sash lock assembly for a sash window assembly, the sash window assembly having an upper sash window and a lower sash window slidable within a master frame, the upper sash window having a keeper connected thereto, the sash lock assembly comprising:

a housing adapted to be mounted on the lower sash window, the housing having an opening therein;

a cam positioned within the housing;

an actuator handle extending through the opening in the housing and connected to the cam such that the actuator handle and the cam rotate together in a generally horizontal plane, the actuator handle rotatable to adjust the sash lock assembly between a locked position, wherein the cam is adapted to engage the keeper, and an unlocked position, wherein the cam is adapted to disengage from the keeper, the actuator handle having an integral engaging surface thereon; and a protrusion positioned on the housing, wherein when the sash lock assembly is in the locked position, the actuator handle is moveable between a first position, wherein the protrusion engages the engaging surface to prevent rotation of the actuator handle, and a second position, wherein movement of the actuator handle from the first position to the second position is accomplished via pivoting of the actuator handle to raise the engaging surface above the protrusion, the handle and its engaging surface move generally vertically to clear the protrusion and allow rotation of the actuator handle.

19. The sash lock assembly of claim 18, wherein the housing has a top surface having an upper surface and a lower surface, the opening positioned in the upper surface, and the protrusion positioned on the upper surface.

20. The sash lock assembly of claim 18, wherein the actuator handle has a base, a shaft projecting downwardly from the base through the opening to connect to the cam, and a lever projecting outwardly from the base substantially perpendicular to the shaft, wherein the actuator handle has a tab extending from the base, the tab having the engaging surface thereon such that the protrusion engages the tab when the sash lock assembly is in the locked position and the actuator handle is in the first position.

21. The sash lock assembly of claim 18, wherein the actuator handle has a base, a shafi projecting downwardly from the base through the opening to connect to the cam, and a lever projecting outwardly from the base substantially perpendicular to the shaft, and wherein the engaging surface is defined generally at a mid-portion of the lever of the actuator handle.

22. The sash lock assembly of claim 18, wherein the protrusion has an inclined surface, and wherein the inclined surface engages and deflects the actuator handle when the actuator rotates to move the sash lock assembly from the unlocked position to the locked position.

23. The sash lock assembly of claim 18, wherein the protrusion is arcuate in shape.

24. A sash lock assembly for a sash window assembly, the sash window assembly having an upper sash window and a lower sash window slidable within a master frame, the upper sash window having a keeper connected thereto, the sash lock assembly comprising:

a housing adapted to be mounted on the lower sash window, the housing having an opening therein;

a cam positioned within the housing;

an actuator handle extending through the opening in the housing and connected to the cam such that the actuator handle and the cam rotate together, the actuator handle rotatable to adjust the sash lock assembly between a locked position, wherein the cam is adapted to engage the keeper, and an unlocked position, wherein the cam is adapted to disengage from the keeper; and an anti-rotation device comprising a protrusion positioned on the housing, wherein when the sash lock assembly is in the locked position, the protrusion engages an engaging surface on the actuator handle to prevent rotation of the actuator handle, and wherein upon deflection of the actuator handle when the sash lock assembly is in the locked position, the engaging surface moves to clear the protrusion, permitting movement of the actuator to place the sash lock assembly in the unlocked position, wherein the actuator handle is resiliently flexible and deflection of the actuator handle is accomplished via flexing of the actuator handle to raise the engaging surface above the protrusion.

25. A sash lock assembly for a sash window assembly, the sash window assembly having an upper sash window and a lower sash window slidable within a master frame, the upper sash window having a keeper connected thereto, the sash lock assembly comprising:

a housing adapted to be mounted on the lower sash window, the housing having an opening therein;

a cam positioned within the housing;

an actuator handle extending through the opening in the housing and connected to the cam such that the actuator handle and the cam rotate together, the actuator handle rotatable to adjust the sash lock assembly between a locked position, wherein the cam is adapted to engage the keeper, and an unlocked position, wherein the cam is adapted to disengage from the keeper; and an anti-rotation device comprising a protrusion positioned on the housing, wherein when the sash lock assembly is in the locked position, the protrusion engages an engaging surface on the actuator handle to prevent rotation of the actuator handle, and wherein upon deflection of the actuator handle when the sash lock assembly is in the locked position, the engaging surface moves to clear the protrusion, permitting movement of the actuator to place the sash lock assembly in the unlocked position, wherein the protrusion has an inclined surface, and wherein the inclined surface engages and deflects the actuator handle when the actuator rotates to move the sash lock assembly from the unlocked position to the locked position.

* * * * *

UNITED STATES PATENT AND TRADEMARK OFFICE

CERTIFICATE OF CORRECTION

PATENT NO. : 7,510,221 B2
APPLICATION NO. : 11/673412
DATED : March 31, 2009
INVENTOR(S) : Mark Eenigenburg et al.

It is certified that error appears in the above-identified patent and that said Letters Patent is hereby corrected as shown below:

On the Title Page, Item (56) under U.S. Patent Documents (Page 2, Line 30):
Please replace "Wikinson" with --Wilkinson--.

Column 12, Claim 21, Line 30:
Please replace "a shafi projecting" with --a shaft projecting--.

Signed and Sealed this

Twenty-second Day of September, 2009

David J. Kappos

David J. Kappos
*Director of the United States Patent and Trademark Office*